US006132133A

United States Patent [19]

Muro et al.

[11] Patent Number: 6,132,133

[45] Date of Patent: Oct. 17, 2000

[54] CRAWLER TYPE VIBRATORY COMPACTING MACHINE

[75] Inventors: Tatsuro Muro, Matsuyama; Hiroyuki Inoue, Kawasaki; Kazuhiro Yoshida, Yokohama; Tatsuo Ohashi, Kashiwazaki, all of Japan

[73] Assignee: Komatsu Ltd., Tokyo, Japan

[21] Appl. No.: 09/202,273

[22] PCT Filed: Jun. 11, 1997

[86] PCT No.: PCT/JP97/02021

§ 371 Date: Dec. 10, 1998

§ 102(e) Date: Dec. 10, 1998

[87] PCT Pub. No.: WO97/47823

PCT Pub. Date: Dec. 18, 1997

[30] Foreign Application Priority Data

Jun. 12, 1996 [JP] Japan ..... 8-172981

[51] Int. Cl.[7] ..... E02D 3/074

[52] U.S. Cl. ..... 404/102; 404/117; 180/9.46; 305/120

[58] Field of Search ..... 404/102, 117, 404/122, 124, 128, 132, 133.05; 180/9, 9.42, 9.46, 9.62, 9.44; 305/120, 157, 160, 185

[56] References Cited

U.S. PATENT DOCUMENTS

| | | | |
|---|---|---|---|
| 3,696,878 | 10/1972 | Nelson | 180/9.46 |
| 3,871,788 | 3/1975 | Barsby | 404/117 |
| 4,577,995 | 3/1986 | Sadahiro | 404/117 |
| 4,647,247 | 3/1987 | Sandstrom | 404/75 |
| 4,661,011 | 4/1987 | Halim | 404/124 |
| 4,737,050 | 4/1988 | Halim | 404/75 |
| 5,343,960 | 9/1994 | Gilbert | 172/823 |
| 5,388,656 | 2/1995 | Lagasse | 180/9.21 |
| 5,797,699 | 8/1998 | Blancke et al. | 404/117 |
| 5,924,503 | 7/1999 | Lykken | 180/6.7 |

FOREIGN PATENT DOCUMENTS

| | | |
|---|---|---|
| 0200949 | 11/1986 | European Pat. Off. . |
| 58-135231 | 8/1983 | Japan . |
| 61-257506 | 11/1986 | Japan . |
| 62-164904 | 7/1987 | Japan . |
| 1-119407 | 8/1989 | Japan . |
| 5-41761 | 6/1993 | Japan . |
| 7-23609 | 3/1995 | Japan . |

*Primary Examiner*—James A. Lisehora
*Attorney, Agent, or Firm*—Sidley & Austin

[57] ABSTRACT

A crawler type vibratory compacting machine of the invention compacts the ground from a surface layer to a deep layer with high efficiency. The crawler type vibratory compacting machine comprises: a triangular crawler unit which includes one wide track (35) or a plurality of juxtaposed tracks **(35*a*, 35*b*, 35*c*) wound around wheels (32, 34) arranged along the length of and above a track frame (31); and a vibrator (40) which is housed in the crawler unit. The crawler unit has opposite lateral ends of its center coupled via a first lateral shaft (23) and pins, to an arm (20) which extends from a vehicle body (10) having an operators seat (11)**.

28 Claims, 18 Drawing Sheets

| MOUNTING DIRECTION OF VIBRATION SHAFT (NO. OF SHAFTS) | VIBRATING DIRECTION | | |
|---|---|---|---|
| | LONGITU-DINAL | TRANSVERSE | VERTICAL |
| VERTICAL SHAFTS (2) | × | ◎ | |
| LATERAL SHAFT (1) | ○ | | ○ |

| MOUNTING DIRECTION OF VIBRATION SHAFT (NO OF SHAFTS) | VIBRATING DIRECTION | | |
|---|---|---|---|
| | LONGITU-DINAL | TRANSVERSE | VERTICAL |
| VERTICAL SHAFT (1) | ○ | ○ | |
| LONGITUDINAL SHAFTS (2) | | × | ◎ |

| MOUNTING DIRECTION OF VIBRATION SHAFT (NO. OF SHAFTS) | VIBRATING DIRECTION | | |
|---|---|---|---|
| | LONGITU-DINAL | TRANSVERSE | VERTICAL |
| LONGITUDINAL SHAFTS (2) | | ◎ | × |
| LATERAL SHAFT (1) | ○ | | ○ |

| MOUNTING DIRECTION OF VIBRATION SHAFT (NO. OF SHAFTS) | VIBRATING DIRECTION | | |
|---|---|---|---|
| | LONGITU-DINAL | TRANSVERSE | VERTICAL |
| VERTICAL SHAFT (1) | ○ | ○ | |
| LONGITUDINAL SHAFT (1) | | ○ | ○ |

| MOUNTING DIRECTION OF VIBRATION SHAFT (NO. OF SHAFTS) | VIBRATING DIRECTION | | |
|---|---|---|---|
| | LONGITU-DINAL | TRANSVERSE | VERTICAL |
| VERTICAL SHAFTS (2) | ◎ | × | |
| LONGITUDINAL SHAFT (1) | | ○ | ○ |

| MOUNTING DIRECTION OF VIBRATION SHAFT (NO. OF SHAFTS) | VIBRATING DIRECTION | | |
|---|---|---|---|
| | LONGITU-DINAL | TRANSVERSE | VERTICAL |
| LATERAL SHAFTS (2) | ◎ | | × |
| LONGITUDINAL SHAFT (1) | | ○ | ○ |

CRAWLER TYPE VIBRATORY COMPACTING MACHINE

FIELD OF THE INVENTION

The present invention relates to a crawler type vibratory compacting machine which can compact the ground, from a surface layer to a deep layer, with high efficiency.

BACKGROUND OF THE INVENTION

Generally, self-propelled vibratory compacting machines are roughly classified into roller type machines and crawler type machines (with tracks or crawlers). Most of the roller type machines are designed for dedicated applications, and include vibrators for generating vertical vibrations (hereinafter called "vertical vibrators"). With the roller type vibratory compacting machine, its roller has a substantially line contact with the surface of the ground, and applies a large surface pressure per unit area of the ground. Therefore, such a machine suffers from the following problems. First of all, when compacting soft ground, the large surface pressure per unit area tends to distort the surface layer of the soft ground, which means that the surface layer cannot be compacted. Secondly, when compacting hard ground, a surface layer of such hard ground can be compacted, but there can be a large disparity between the rigidity of the surface layer and that of a deep layer, so that the deep layer cannot be completely compacted. Basically, the deep layer can be compacted by increasing the weight and the vertical vibrations of the compacting machine. However, if such measures are taken and great pressure per unit area, larger than the pressure per unit area that the particular type of ground can endure, is applied, the surface layer of the hard ground is not compacted, as is the case with soft ground. In other words, the hard ground can be compacted to a depth of approximately 30 cm at most.

Japanese Patent Publication No. Hei 5-41761 discloses a "Roller type vibratory compacting machine having a large eccentric weight and a small eccentric weight that rotate at low and high speeds, respectively", and pays particular attention to the fact that "the machine can compact a deep layer of the ground by rotating the large eccentric weight of a vertical vibrator at a low speed and with large amplitude, while the surface layer can be compacted by rotating the small weight at a high speed and with small amplitude".

Japanese Utility Model Laid-open No. Hei 1-119407 discloses a "Roller type vibratory compacting machine", and pays particular attention to the fact that "when a roller is horizontally vibrated, moisture and air is discharged from the ground, which enhances compacting of the ground," and that "horizontal vibrations are less hazardous to the environment than vertical vibrations." In the Utility Model, a horizontal vibrator is employed in place of a vertical vibrator.

Contrary to the roller type vibratory compacting machine, a crawler type vibratory compacting machine comes into substantial surface contact with the ground. Although the surface pressure per unit area is small, such a machine can apply the pressure to a wide area of the ground surface. In other words, the disparity between the pressure applied to a unit area of the surface layer of the ground and the pressure applied to a unit area of the deep layer is much smaller than that of the roller type vibratory compacting machine. Further, the surface pressure is applied to the ground for a longer period of time during forward and backward movements of the crawler type vibratory compacting machine, compared with the roller type vibratory compacting machine, i.e. the surface pressure lasts far longer than in the roller type machine. Therefore, the crawler type machine can carry out a uniform compacting of the ground from the surface layer to the deep layer. The crawler type machine is free from the first and second problems, and is advantageous in that it can compact a deep layer of the ground (approximately 1 meter deep). The following proposals have been made in publications related to crawler type vibratory compacting machines.

(1) Japanese Patent Laid-open No. Sho 58-135231 discloses a "Crawler type shovel having vertical vibrators attached to left and right track frames."

(2) Japanese Patent Laid-open No. Sho 61-257506 discloses a crawler type vibratory compacting machine which comprises: (A) an upper structure including a power source; (B) a lateral plate positioned under the upper structure in order to support it via a spring; (C) left and right side plates extending from left and right ends of the lateral plate; (D) a bottom plate arranged between lower sides of the left and right side plates, and supporting a vertical vibrator on the upper surface thereof; (E) drive sprockets and driving wheels positioned at the front and rear parts of the bottom plate, and rotatably supported by front and rear ends of the left and right side plates, respectively; and (F) left and right tracks wound around the drive sprockets and driving wheels and an outer surface of the bottom plate.

(3) Japanese Patent Publication No. Hei 7-23609 discloses a "Crawler type vibratory compacting machine", in which a vertical vibrator is installed on the frame of a self-propelled crawler type vehicle, and energy for running, steering and vibrating actions is supplied via flexible energy supply tubes from a power unit provided at a remote location.

However, the foregoing self-propelled vibratory compacting machines still suffer from the following problems.

Specifically, there are the foregoing first problem that roller type machines cannot compact soft ground, and the second problem that the roller type machines can only compact hard ground to a depth of approximately 30 cm at maximum. Japanese Patent Publication No. Hei 5-41761 discloses that "the self-propelling vibratory compacting machine can compact both the surface layer and the deep layer of the ground", but does not specify a depth of the ground that can be compacted, and leaves the first problem unsolved.

Japanese Utility Model Laid-open No. Hei 1-119407 leaves the first problem unsolved. The horizontal vibrations of the horizontal vibrator allow moisture and air to be discharged from "the ground where the roller is in line contact with the ground which is free from the roller". However, the ground which is free from the roller includes the surface layer of the ground that has been already compacted by the roller. Moisture and air will also be forced into the already compacted surface layer. Therefore, the already compacted surface layer increases its moisture content, and may be distorted by the vertical vibrations transferred from the ground being in line contact with the roller, and thus softened.

The foregoing crawler type vibratory compacting machines have the following problems. Japanese Patent Laid-open No. Sho 58-135231 relates to a power shovel including a pair of crawler type tracks attached to the left and right sides of the vehicle body. One forward or backward movement of the shovel cannot compact the ground which is not in contact with the left track or the right track. Further, since no springs are used, the vertical vibrations of the vibrator are transmitted to the operator and the vehicle body, which may be uncomfortable to the operator, adversely affect the operator's health, and shorten the life of various components of the machine.

The problem related to the absence of springs does not affect Japanese Patent Laid-open No. Sho 61-257506 in which the upper structure having the power unit is installed on springs. Further, the bottom plate receives vertical vibrations and the weight of the vehicle body, so that large vertical vibrations can be produced. However, the vehicle is moved back and forth by causing the track to slide on the rear surface of the bottom plate in response to the rotation of a drive sprocket. Therefore, the drive sprocket has to produce a driving force that can overcome the sliding resistance of the track. Further, in order to compact the ground, downward vibrations act in order to periodically press the bottom plate against the track, and to periodically increase the sliding friction between the rear surface of the bottom plate and the upper surface of the track. This periodical large sliding friction serves as a damping force for the drive sprocket, which shortens the lifespan of the drive sprocket and the power transmission system therefor. In addition, there is a problem in that both the bottom plate and the track will be excessively worn due to the sliding.

Japanese Patent Publication No. Hei 7-23609 is free from the problem of the power unit being damaged by vibrations, since the power unit is positioned far from the machine body. However, a pair of the crawler type tracks are spaced apart, so that one forward or backward movement of the machine cannot compact the ground that is not in contact with either of the tracks.

The existing machines have been respectively reviewed. In summary, the existing self-propelled vibratory compacting machines have not made sufficient use of the merits of roller type vibratory compacting machines and the crawler type machines, and have not enhanced the advantages of the crawler type machines.

SUMMARY OF THE INVENTION

The present invention has been contemplated in order to overcome the foregoing problems of the related art, and is intended to provide a crawler type vibratory compacting machine that can reliably compact soft ground, as well as ordinary ground, from a surface layer to a deep layer without causing environmental problems.

There is provided a crawler type vibratory compacting machine comprising: a triangular crawler unit which includes one wide track or a plurality of juxtaposed tracks wound around wheels arranged along the length of or above a track frame; and a vibrator housed in the crawler unit.

The crawler unit applies to the ground a smaller surface pressure per unit area as compared to a roller type unit. The larger the surface pressure per unit area, the more efficiently and reliably the ground can be compacted. However, when the crawler type vibratory compacting machine is made heavy, it inevitably becomes large, and is difficult to store and transport. Further, such a large machine is not economical. In order to overcome the foregoing problem, it is possible to enlarge the vibrator, but there is still a problem in securing a space for housing a large vibrator. The invention overcomes this problem by making the crawler unit triangular. This enables the small crawler type vibratory compacting machine to accommodate a large vibrator, and to generate large vibrations. Further, the crawler type machine can uniformly and reliably compact from a surface layer to a deep layer of not only ordinary ground but also soft ground.

A first horizontal lateral shaft, located in a central portion of the crawler unit, has its opposite ends coupled to respective arms of a yoke shaped member, which is coupled to a vehicle body by pins. The vehicle body includes an operator's seat and a power unit.

This arrangement is effective in the following respects. As will be described in detail later with reference to embodiments, the crawler type vibratory compacting machine can reliably compact the ground from the surface layer to a deep layer when it is in contact with the ground via a square area, and when the surface pressure per unit area is increased. In actual applications, these requirements are contradictory. In an existing crawler type vibratory compacting machine, a crawler unit provided with a vibrator is disposed directly on a vehicle body having an operator's seat and a power unit. In such an arrangement, the square ground contact area of the crawler unit should be reduced in order to increase the surface pressure. If such a measure is taken, the machine has its center of gravity at a high level, which means that it is dangerous to load or unload the machine onto or from a trailer track, or to have the machine travel over extremely uneven sites. In accordance with the present invention, the crawler unit with the vibrator is independent from the vehicle body, and is coupled to the vehicle body via the yoke shaped member. This arrangement prevents the machine from falling down, for example. However, the arrangement alone implies that the crawler unit and the vehicle body may be coupled in a fixed manner. In such a case, it is difficult or impossible to easily load or unload the machine onto or from a trailer track, or to travel the machine on uneven sites. Therefore, the crawler unit and the yoke shaped member are coupled via the first horizontal lateral shaft using pins, which overcomes the problem related to loading or unloading, and traveling over uneven sites.

The vibrator includes at least a vertical vibrating unit for generating vertical vibrations. The vertical vibrating unit can have a vibration center that is located substantially on a vertical line passing through the center line of the first horizontal lateral shaft. Further, attenuating means can be provided between the crawler unit and the yoke shaped member in order to attenuate the force produced by the relative rotation of the crawler unit and the yoke shaped member around the first horizontal lateral shaft. This arrangement can suppress generation of a rocking motion. In other words, the vertical vibrating unit is prevented from causing a rocking motion in response to a small force applied thereto. Such rocking motion can be immediately attenuated even if it is generated. Therefore, the ground can be effectively and reliably compacted.

A plurality of road wheels are arranged on an underside of the track frame along the length thereof. Mounting positions of the road wheels are raised from the center of the track frame toward front and rear ends thereof. This arrangement enables the machine to automatically perform center adjustment, and protects the machine against the rocking motion.

Further, the vibrator can include a horizontal vibrating unit for generating horizontal vibrations and a vertical vibrating unit for generating vertical vibrations. The horizontal vibrating unit can be positioned in the bottom center portion of the crawler unit, and the vertical vibrating unit can be positioned above the horizontal vibrating unit.

According to this arrangement, the track comes into surface contact with the ground, and applies both vertical and horizontal vibrations into the ground. With the roller type machine, the horizontal vibrations tend to soften a surface layer that has been already compacted. However, with the crawler type machine, the track can come into contact with a wide surface area of the ground. Therefore, moisture in the area of the ground, where the crawler type machine is in contact, is forced into gaps in the same ground, so that the moisture content remains unchanged. An area where gaps are pressed by the crawler type machine and an area where moisture is transferred from the pressed area constitute an area compacted by the crawler type machine. In short, the crawler type machine can prevent the already compacted area from being softened by horizontal vibrations. Further, the crawler type machine can efficiently and reliably compact a deep layer of the ground using vertical vibrations. With the roller type machine, vertical vibrations tend to compact only the surface layer and leave the deep layer soft. In accordance with the present invention, the vertical and horizontal vibrations act together with each other in synergism, thereby uniformly compacting the ground from the surface layer to a deep layer. Further, horizontal vibrations promote compacting of the ground by the vertical vibrations, which is effective in reducing any trouble caused by vertical vibrations.

The yoke shaped member, extending from opposite lateral sides of the center of the crawler unit, can be coupled to the vehicle body, having the operator's seat and power unit, via the second horizontal lateral shaft, using pins. Vertical vibrations generated by the vibrator are absorbed by the pins around the second horizontal lateral shaft, so that the vehicle body is relatively free from vertical vibrations, and can be operated in a preferable state.

Further, the track frame can be divided into an upper track frame for housing the wheels, and a lower track frame for housing the vibrator. The upper and lower track frames can be coupled via second elastic members. With this arrangement, vibrations generated by the vibrator are absorbed by the second elastic members, and are not transmitted to the upper track frame, so that the wheels, etc., housed in the upper track frame are protected against damage.

The invention further provides a crawler type vibratory compacting machine comprising: a triangular crawler unit, which includes one wide track or a plurality of juxtaposed tracks wound around wheels housed in a track frame and a plurality of road wheels disposed on an underside of the track frame; and a vibrator housed in the crawler unit. The road wheels are arranged in a plurality of rows on the wide track or the plurality of juxtaposed tracks.

With the crawler type vibratory compacting machine of the related art, road wheels are arranged in one row on each of a pair of tracks along the length thereof. In such a case, when a vibrator on a track unit is operated, the track frame and the tracks that correspond to a space between the rows of road wheels is flexed by vibrations. This reduces the vibrations applied to the ground, i.e., the vibrations are partly absorbed by the flexing of the foregoing members. In order to overcome this problem, it has been considered to increase the rigidity of the track frame or the tracks. However, such a measure is not preferable since it makes components expensive and enlarges the track frame and tracks. If these components are enlarged, the vibrator should be reduced in size. A small vibrator means that small vibrations are applied to the ground. In accordance with the present invention, the number of rows of the road wheels is increased in order to reduce free spaces of the tracks which are not in contact with the road wheels. This arrangement can relatively increase the rigidity of the track frame and the tracks and prevent them from being flexed in response to vibrations. Further, the tracks are uniformly brought into pressure contact with the ground surface by the road wheels through which vibrations are applied. Therefore, vibrations can be efficiently transmitted into the ground, which enables the ground to be compacted in an optimum state.

A still further crawler type vibratory compacting machine comprises a track wound around a track frame and a vibrator. A track shoe of the track includes elongated ribs arranged across a surface of the track that is not brought into contact with the ground surface during operation of the crawler type vibratory compacting machine. This is effective in increasing the rigidity of the tracks without enlarging them.

There is also provided a crawler type vibratory compacting machine comprising a track wound around a track frame and a vibrator. A track shoe of the track includes elongated ribs arranged across a surface of the track that is brought into contact with the ground surface during operation of the crawler type vibratory compacting machine. This is effective in reliably and efficiently transmitting horizontal vibrations, especially transverse vibrations, to the ground, and in protecting the tracks against side slip.

BRIEF DESCRIPTION OF THE DRAWINGS

FIG. 9 is a top plan view of a first example of the rocking motion suppressing arrangement, specifically showing a first lateral shaft.

FIG. 10 is a side view of the crawler type vibrating section, showing a second example of the rocking motion suppressing arrangement.

FIG. 11 is a top plan view of first lateral shaft used in the second example shown in FIG. 10.

FIG. 12 is a front view of the first left and right shafts in the second example shown in FIG. 10.

FIG. 13 shows the arrangement of road wheels, showing a third example of the rocking motion suppressing arrangement.

FIGS. 20A and 20B show a track shoe having long transverse ribs on a surface of the track that is not brought into contact with the ground, in a fifth embodiment of the invention; wherein FIG. 20A is a front view, and FIG. 20B is a side view.

FIGS. 21A, 21B and 21C show a track shoe having long transverse ribs extending on the track, on a side being brought into contact with the ground: wherein FIG. 21A is a front view, FIG. 21B is a side view, and FIG. 21C is a top plan view.

FIG. 22A to FIG. 27B relate to (first to sixth) examples of a vibrator in a seventh embodiment: wherein FIG. 22A is a schematic perspective view of the first example, and FIG. 22B shows how vibrations are generated in the first example; FIG. 27A is a schematic perspective view of the sixth example, and FIG. 27B shows how vibrations are generated in the sixth example.

BEST MODE FOR CARRYING OUT THE EMBODIMENTS

Figure 1:
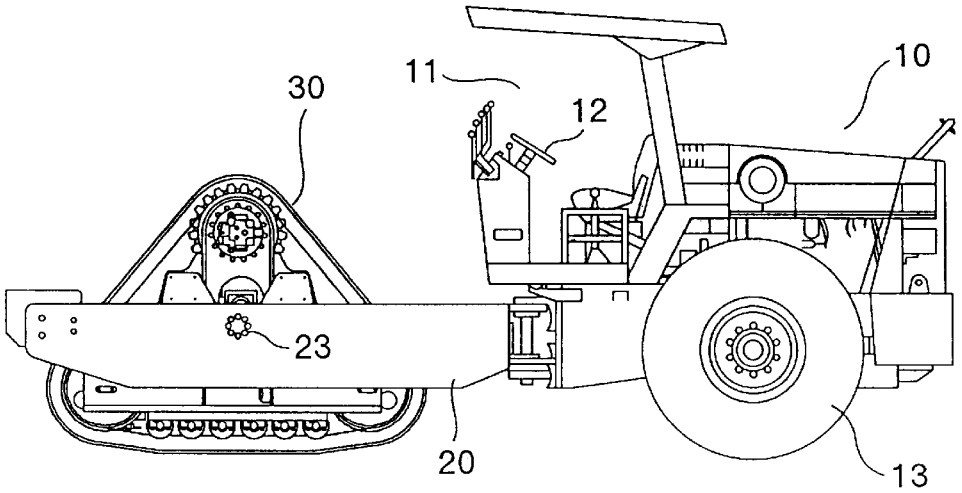
FIG. 1 is a side view of a first machine in accordance with a first embodiment of the invention.

The invention will be described with reference to preferred embodiments shown in the drawings.

Figure 2:
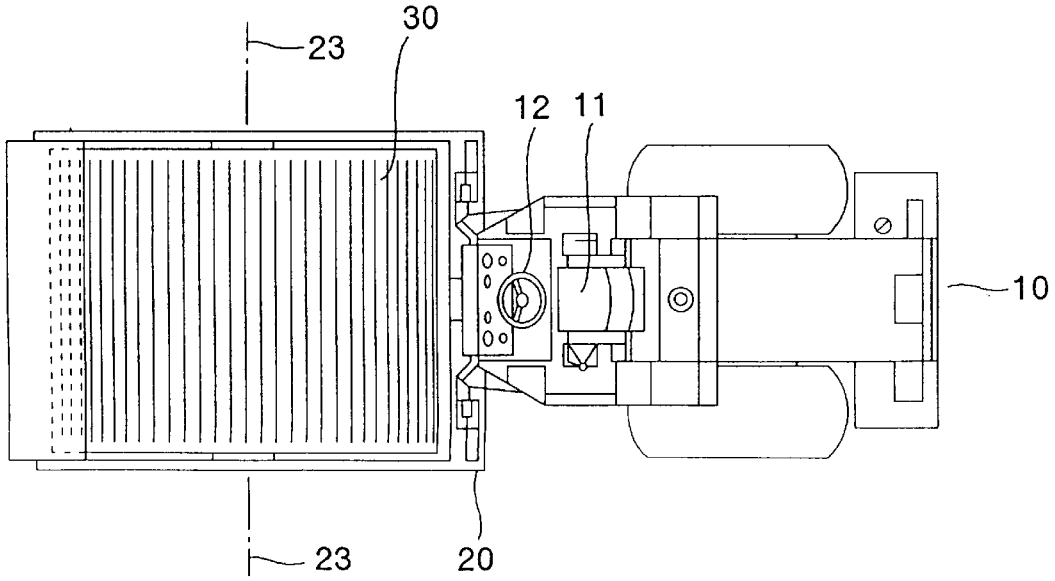
FIG. 2 is a top plan view of the first machine.

Referring to FIGS. 1 and 2, a crawler type vibratory compacting machine according to a first embodiment (called "the first machine") comprises: a vehicle body 10, having a pair of tires 13; a yoke-shaped member 20; and a crawler type vibrating section 30.

Figure 3:
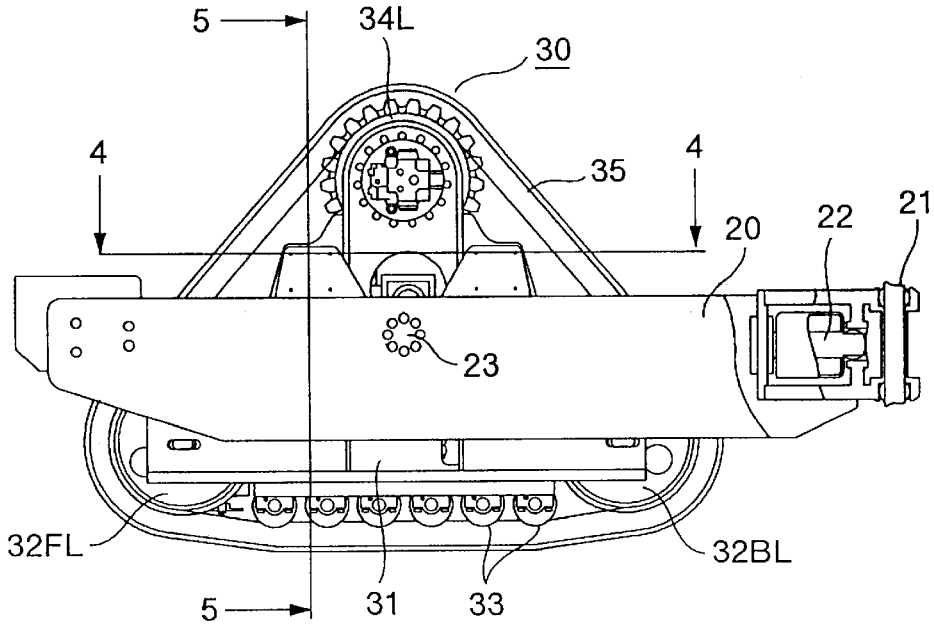
FIG. 3 is an enlarged side view of a yoke-shaped member and a crawler type vibrator of the first machine of FIG. 1.

The vehicle body 10 is mainly provided with an operator's seat 11, a steering wheel 12, and a power unit (not shown), and is moved by rotating the tires 13. As shown in FIG. 3, the rear center of the yoke-shaped member 20 is coupled to the front center of the vehicle body 10 by a vertical shaft 21 and a horizontal shaft 22, which extends along the length of the yoke shaped member 20 (the horizontal shaft 22 is called "the longitudinal shaft 22") The yoke-shaped member 20 houses the crawler type vibrator 30 in a space defined by the spaced apart arms, and supports it via the horizontal shaft 23, which extends laterally across the center of the vibrator 30 between the spaced apart arms (the horizontal shaft 23 is called the "first lateral shaft 23"). A hydraulic cylinder (not shown), which is provided between the front end of the vehicle body 10 and the tear end of the yoke shaped member 20, is freely expanded or contracted in response to the operation of the steering wheel 12. Specifically, the hydraulic cylinder is expanded or contracted in accordance with the steering amount of the steering wheel 12 as manipulated by the operator. In response to the expansion or contraction of the hydraulic cylinder, the yoke shaped member 20 (i.e. the crawler type vibrating section 30) yaws around the vertical shaft 21, so that the crawler type vibrating-compacting machine is steered. The first machine is a so-called articulated vehicle. When the first machine is moved on very uneven ground, any relative rolling of the vehicle body 10 and the crawler type vibrating section 30 is absorbed by the rocking of the yoke-shaped member 20 around the longitudinal shaft 22. Further, any pitching of the crawler type vibrating section 30 is absorbed by the rocking motion of the yoke-shaped member 20 around the first lateral shaft 23.

Figure 4:
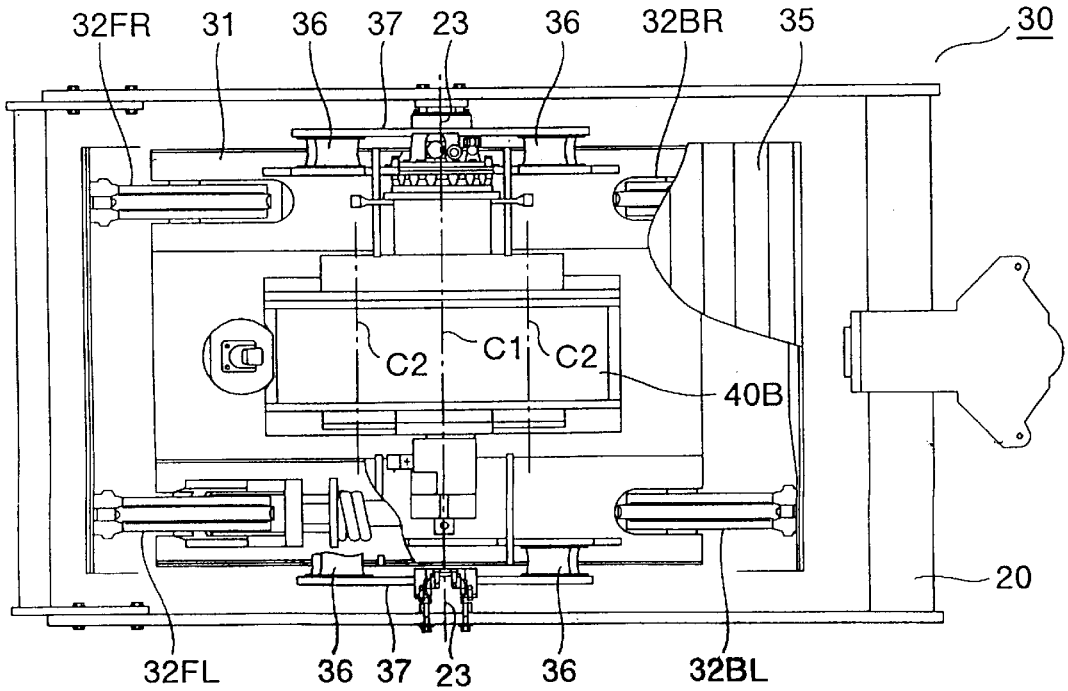
FIG. 4 is a sectional view of the first machine, taken along line 4—4 in FIG. 3.
Figure 5:
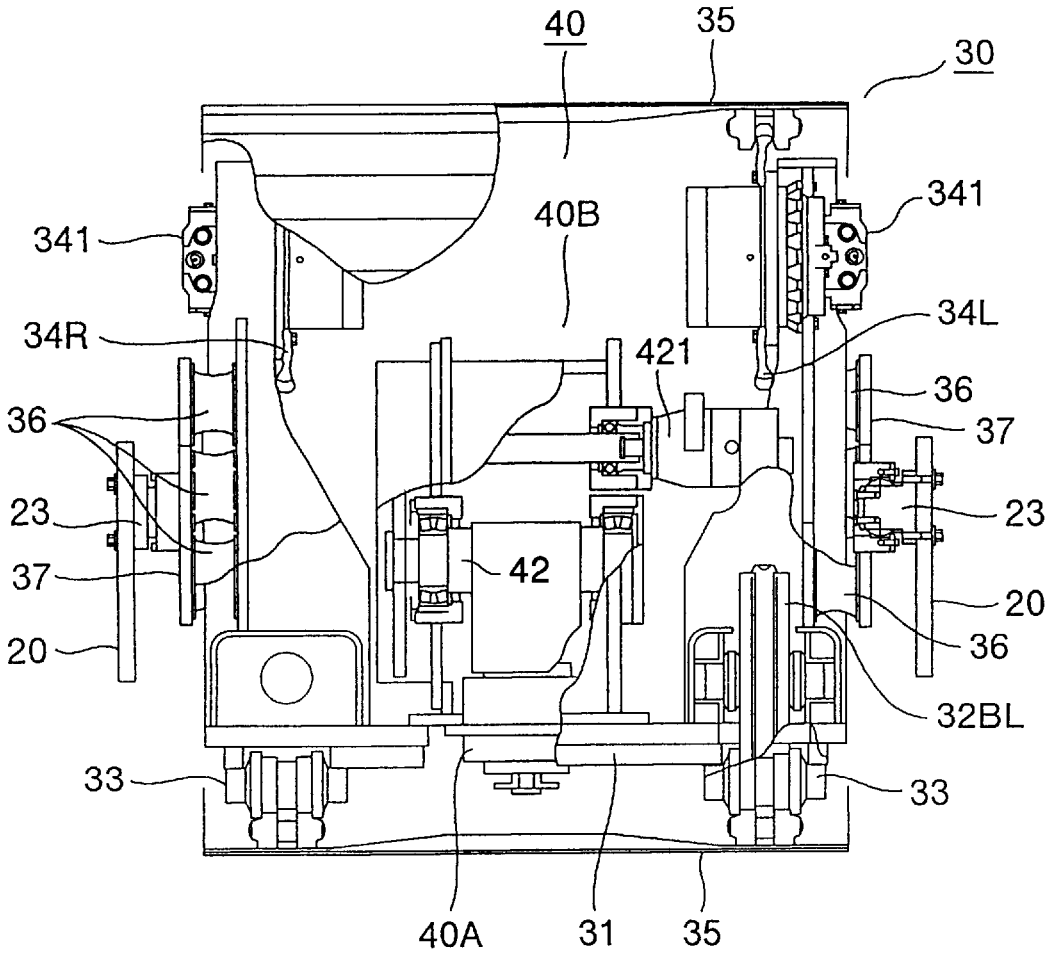
FIG. 5 is a sectional view of the first machine, taken along line 5—5 in FIG. 3.

Referring to FIGS. 3 to 5, the crawler type vibrating section 30 comprises a crawler unit, and a vibrator 40 housed within the crawler unit. The crawler unit includes: one track frame 31; a group of driving wheels 32 (i.e. the left and right front driving wheels 32FL and 32FR and the left and right rear driving wheels 32BL and 32BR); a plurality of road wheels 33, which are positioned between the front and rear driving wheels 32 (i.e., the left and right front driving wheels 32FL and 32FR, and the left and right rear driving wheels 32BL and 32BR), and are arranged on the lower surface of the track frame 31 along the length of the crawler type vibrating section 30; a pair of drive sprockets 34 (i.e. the left and right drive sprockets 34L and 34R); and a wide track 35, which is wound around the driving wheels 32, the road wheels 33, and the vibrator 40. In other words, the crawler unit is in the shape of a triangle as shown in FIGS. 1 and 3, when observed from a side of the first machine. Each of the drive sprockets 34 has its own hydraulic motor 341, and is rotated by the rotational force supplied by the hydraulic motor 341 in response to the operator's operation.

Figure 6:
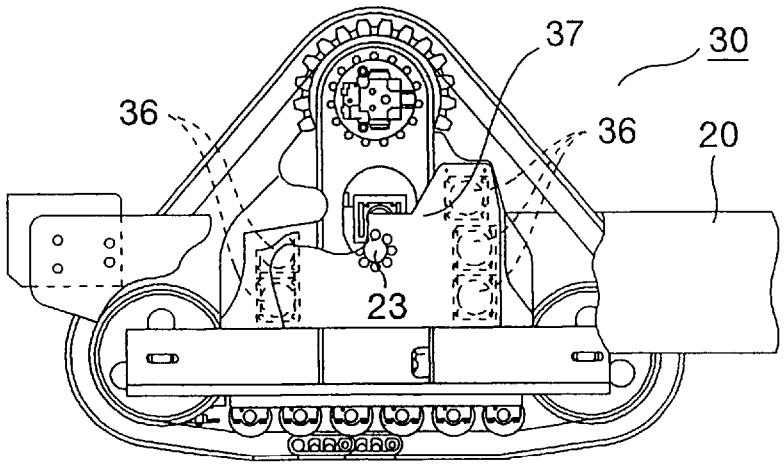
FIG. 6 is a side view showing first elastic members and a support plate of the first machine of FIG. 1.

As described above, the crawler type vibrating section 30 is housed within the space defined by the frame of the yoke-shaped member 20, and has its center supported by the first lateral shaft 23, as clearly shown in FIGS. 4 to 6. The crawler type vibrating section 30 has a plurality of first elastic members 36 attached around opposite ends of the first lateral shaft 23. Each first elastic member 36 can be attached around an end of the first lateral shaft 23. A support plate 37 is coupled to the outer ends of the first elastic members 36 which are adjacent a respective end of the first lateral shaft 23. Each support plate 37 has its center coupled to an inner surface of the yoke-shaped member 20 via the first lateral shaft 23.

Figure 7:
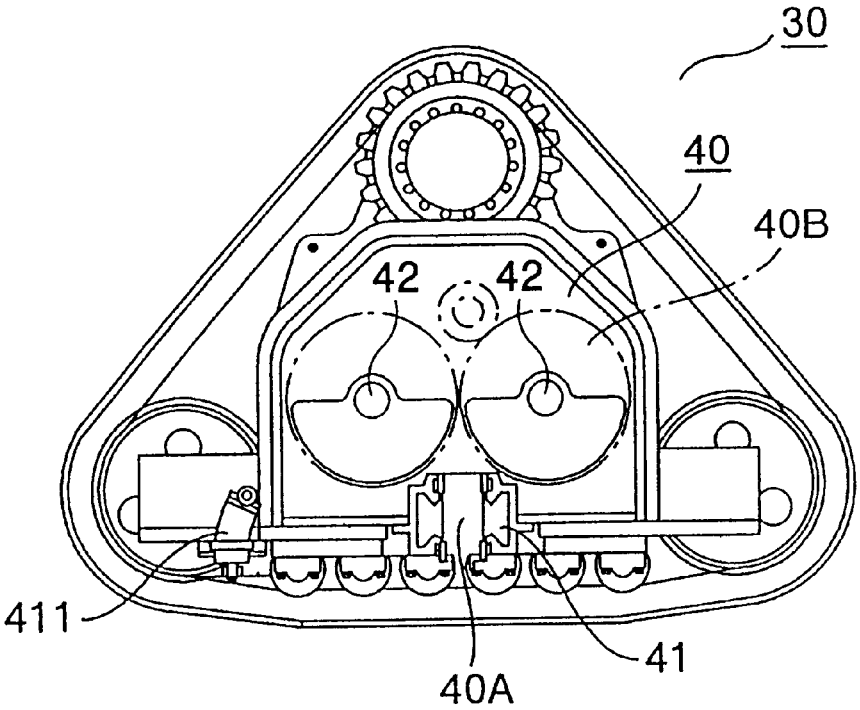
FIG. 7 is a side view showing a vibrator of the first machine.

The vibrator 40 includes a horizontal vibrating unit 40A and a vertical vibrating unit 40B, as shown in FIGS. 4, 5 and 7. The horizontal vibrating unit 40A is installed on the bottom center portion of the track frame 31, and is detachable via an opening formed in the bottom center of the track frame 31. Referring to FIG. 7, the horizontal vibrating unit 40A produces horizontal vibrations when a vertical shaft 41, with one eccentric weight, is rotated by a motor 411 via a chain (not shown). The vertical vibrating unit 40B is arranged above the horizontal vibrating unit 40A and produces vertical vibration when lateral shafts 42, 42, each having an eccentric weight, are rotated by a motor 421. The vertical and horizontal vibrating units 40A and 40B are aligned such that their vibration centers exist substantially in a vertical line that passes through the center line C1 of the first lateral shaft 23. Specifically, the vibrating units 40A and 40B are aligned such that the center line of the space between the center lines C2, C2 of the two lateral shafts 42, 42, each having an eccentric weight, and the axial center of the horizontal vibrating unit 40A are substantially located in a vertical line passing through the center line C1 of the first lateral shaft 23. As shown in FIG. 7, with the vertical vibrating unit 40B, when the two lateral shafts 42, 42, each having an eccentric weight, are rotated by a motor 421, the eccentric weights are aligned with each other in the vertical direction and rotate in opposite directions at the same speed. Therefore, vibration forces in the moving direction of the machine are cancelled while the vertical vibrating force is doubled.

The first embodiment operates and is advantageous as follows.

(1-1) The vibrator 40 includes the horizontal and vertical vibrating units 40A and 40B. Therefore, the vertical and horizontal vibrations are mutually superimposed, so that not only the surface layer but also a deep layer of the ground can be compacted in a preferable manner. The horizontal vibrating unit 40A can reduce problems caused by vibrations.

(1-2) The crawler type vibrating section 30 is constituted by the triangular track unit, so that the vibrator 40, housed therein, can be enlarged. In other words, large vibrating forces can be produced.

(1-3) The crawler type vibrating section 30 is independent from the vehicle body 10, and is coupled to the vehicle body 10 such that the crawler type vibrating section 30 can freely yaw, roll, or pitch with respect to the vehicle body 10. Therefore, the vibrating section 30 can include the large vibrator 40, and be steered as desired. Further, the first machine can be easily loaded onto or unloaded from a trailer truck, and can be moved on uneven sites without difficulty. Still further, the first machine has a low center of gravity which prevents it from tipping over.

(1-4) The crawler type vibrating section 30 is movably supported in the frame of the yoke-shaped member 20 via the first lateral shaft 23 and the first elastic members 36. The first elastic members 36 absorb and attenuate vibrations from the vibrator 40, thereby reducing any vibrations being transmitted to the vehicle body 10. In other words, it is possible to protect the operator against fatigue, improve the ride quality, and lengthen the life of components installed on the vehicle body 10.

Figure 8:
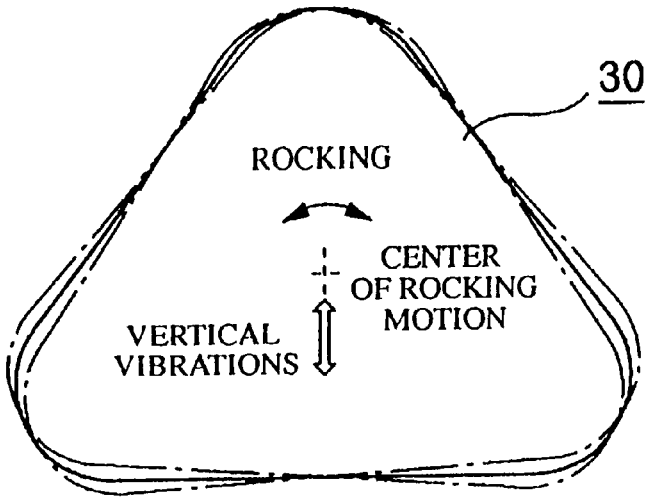
FIG. 8 schematically shows a crawler type vibrating system of the first machine in order to describe rocking motion.

(1-5) The vibrator 40 suppresses the rocking motion. If the horizontal vibrating unit 40A were to be arranged above the vertical vibrating unit 40B, a large moment would act on the upper part of the crawler type vibrating section 30 in the moving directions of the crawler vibratory compacting machine, which would cause the crawler vibrating section 30 to pitch extensively. In other words, vibration energy to be transmitted to the ground would be reduced accordingly. Further, if the horizontal vibrating unit 40A and the vertical vibrating units 40B were to be arranged with their vibration centers positioned outside a vertical line passing through the center line C1 of the first lateral shaft 23, the first machine would be pressed to the ground with an unbalanced force in front of or behind the first lateral shaft 23. As a result, the crawler vibrating section 30 would pitch, i.e. lean to the front or rear side as shown in FIG. 8. This is called the "rocking motion." The rocking motion causes the first machine to come into contact with the ground via the front or the rear driving wheels 32 and the road wheels 33 at the left or right side of the track, and reduces the durability of these wheels. Further, the rocking motion tends to reduce the ground contact area of the wide track 35, which means that the deep layer of the ground will be compacted with reduced efficiency. Specifically, the frequencies of the vibrator 40 of the crawler type vibratory compacting machine are determined to deviate from the natural frequencies of the crawler vibrating section 30 and the vehicle body 10. Further, the frequencies of the vibrator 40 are set considering that the ground is springy. However, if the rocking motion is caused, the ground contact area becomes smaller than a predetermined ground contact area, and the spring coefficient of the ground varies accordingly. The frequencies of the vibrator 40 can approach or equal the natural frequencies of the crawler vibrating section 30 and the vehicle body 10. In such a case, the crawler vibrating section 30 and the vehicle body 10 do not transmit vibrations to the ground but cause each other to resonate, so that their components can be damaged in a relatively short time. In order to overcome the foregoing problems, in the first embodiment, the horizontal vibrating unit 40A is positioned at the bottom center portion of the crawler vibrating section 30, and the vertical vibrating unit 40B is positioned above the horizontal vibrator 40A. Further, the vibrators 40A and 40B are aligned such that their respective vibration centers are substantially located in a vertical line passing through the center line C1 of the first lateral shaft 23. This arrangement can suppress the rocking motion. Further examples (first to third examples) for suppressing the rocking motion will be described with reference to FIGS. 9 to 13.

Figure 9:
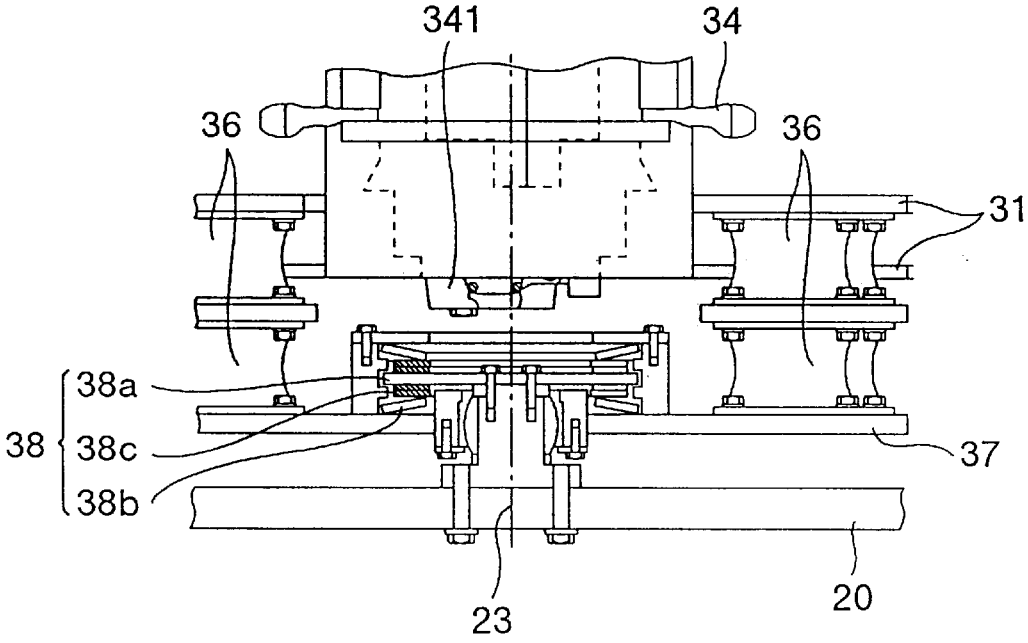
FIGS. 9 to 13 relate to arrangements for suppressing the rocking motion in the first machine.

(1-5-1) In a first example, brakes 38 (dampers) are provided between the first lateral shaft 23 and the support plate 37, as shown in FIG. 9. Each brake 38 includes a disc 38*a*, which is fixed to side edge of the track frame 31 by the first lateral shaft 23 and the yoke-shaped member 20, and a pad 38*c*, which is pressed by a spring 38*b* between the disc 38*a* and the support plate 37. In other words, the spring 38*b* brings the pad 38*c* into pressure contact with the disc 38*a*, thereby making it difficult for the crawler vibrating section 30 to cause the rocking motion in response to a slight force applied thereto, and immediately damping the rocking motion if it is generated. The brakes 38 enhance the compacting operation in a preferable state.

Figure 10:
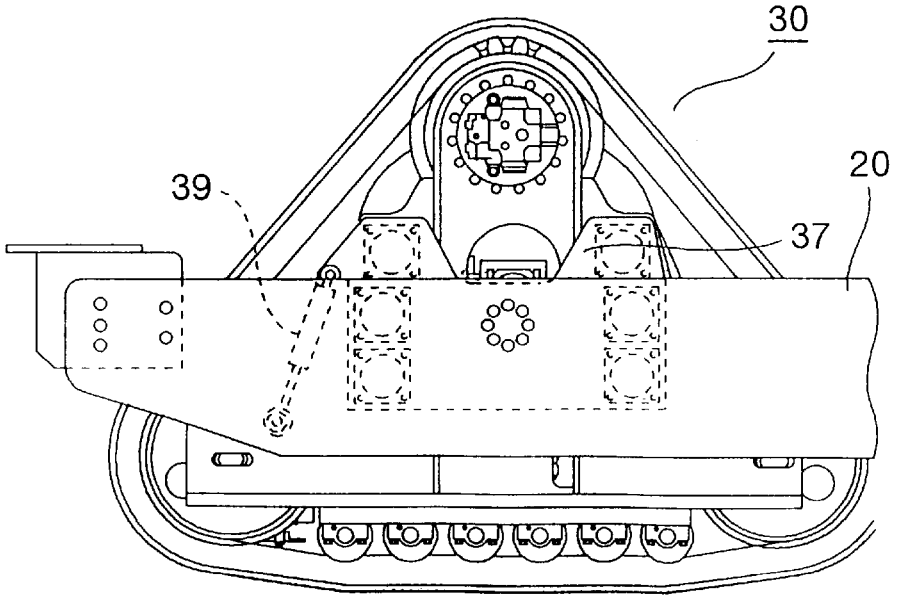
Figure 11:
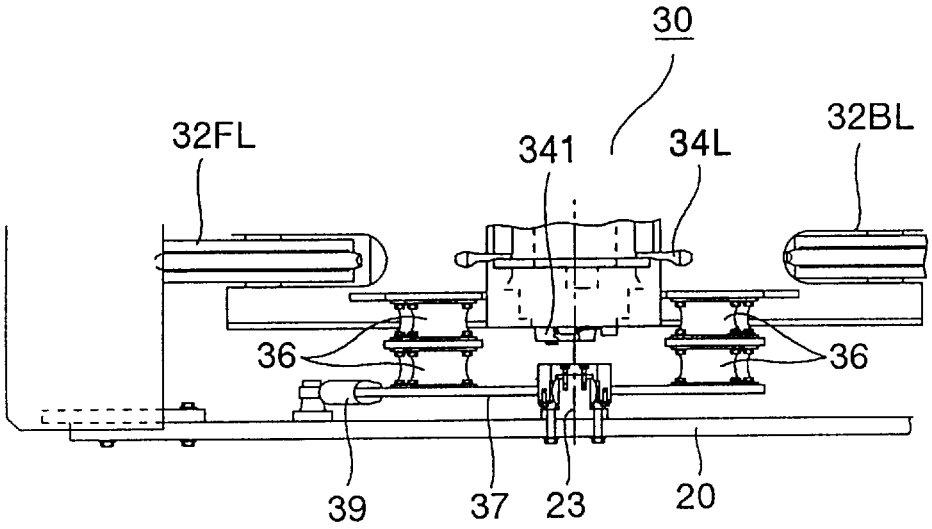
Figure 12:
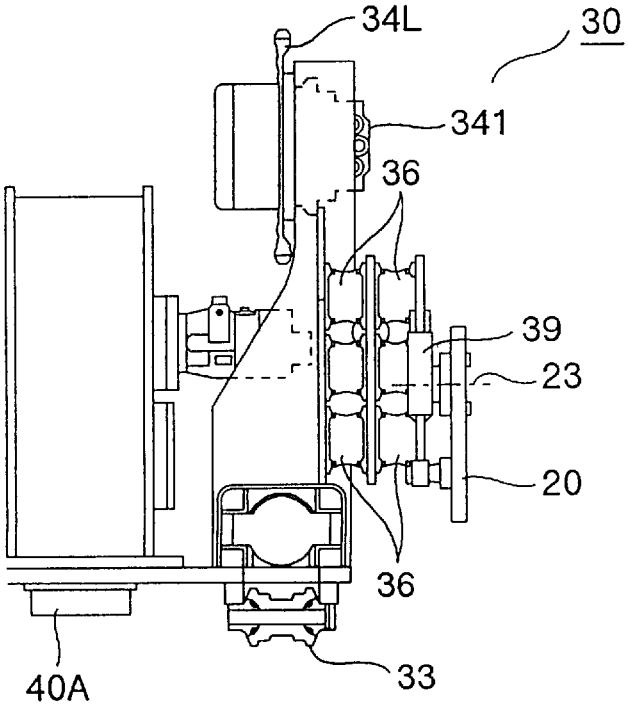
Figure 13:
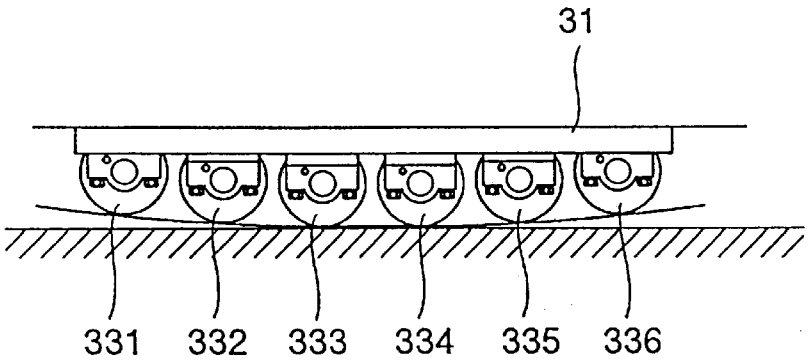

(1-5-2) In a second example, shock absorbing cylinders (dampers) 39 are interposed between the arms of the yoke-shaped member 20 and the support plates 37, as shown in FIG. 10 to FIG. 12. Each cylinder 39 prevents the crawler vibrating section 30 from causing the rocking motion in response to a small force applied thereto, and enables the rocking motion to be attenuated if it is generated. In other words, the cylinders 39 promote the compacting operation in a preferable state.

(1-5-3) According to a third example, the levels at which a plurality of road wheels 33, e.g. road wheels 331, 332, . . . 336, are mounted, are gradually changed along the length of the track. Specifically, the road wheel at the center mounting position project downwardly most extensively while the remaining road wheels are attached at positions which are gradually raised with distance from the center position. This arrangement promotes automatic center adjustment of the crawler type vibrating section 30, which enables it to prevent the rocking motion. Even if the rocking motion is caused, it can be immediately attenuated. Further, even during the rocking motion, the crawler vibrating section 30 does not basically reduce the area it has in contact with the ground surface. The foregoing arrangement of the road wheels 331, 332, . . . 336 is effective in assuring the compacting operation in a preferable state.

Figure 14:
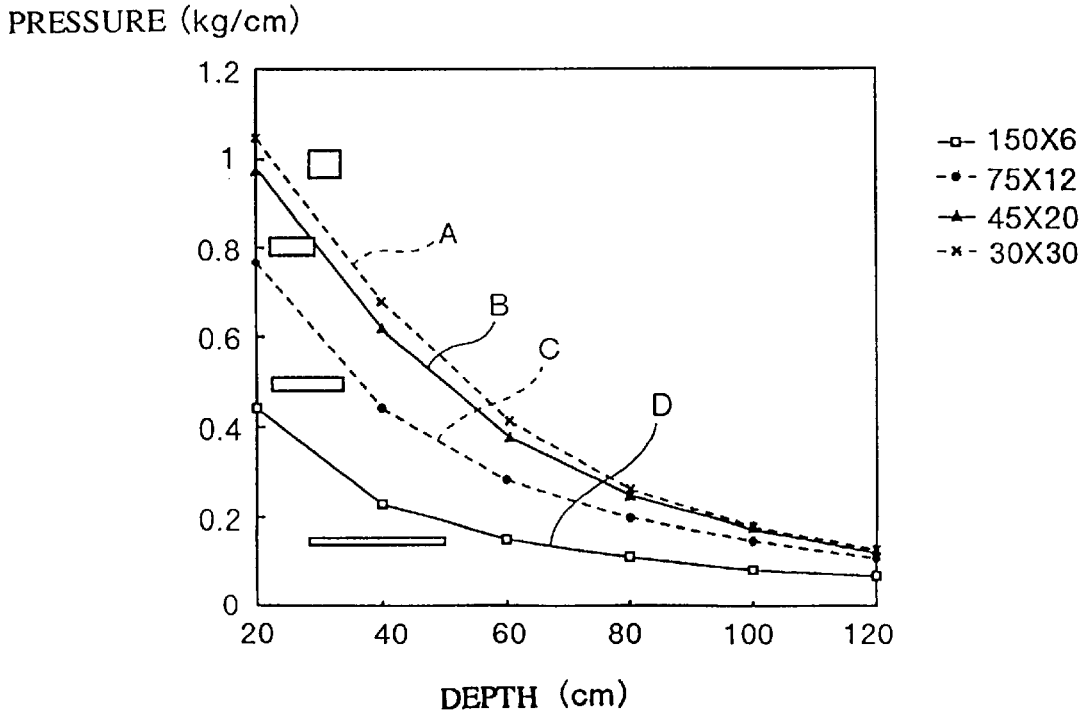
FIG. 14 is a graph of characteristic curves showing stresses applied to the ground by the respective tracks.
Figure 15:
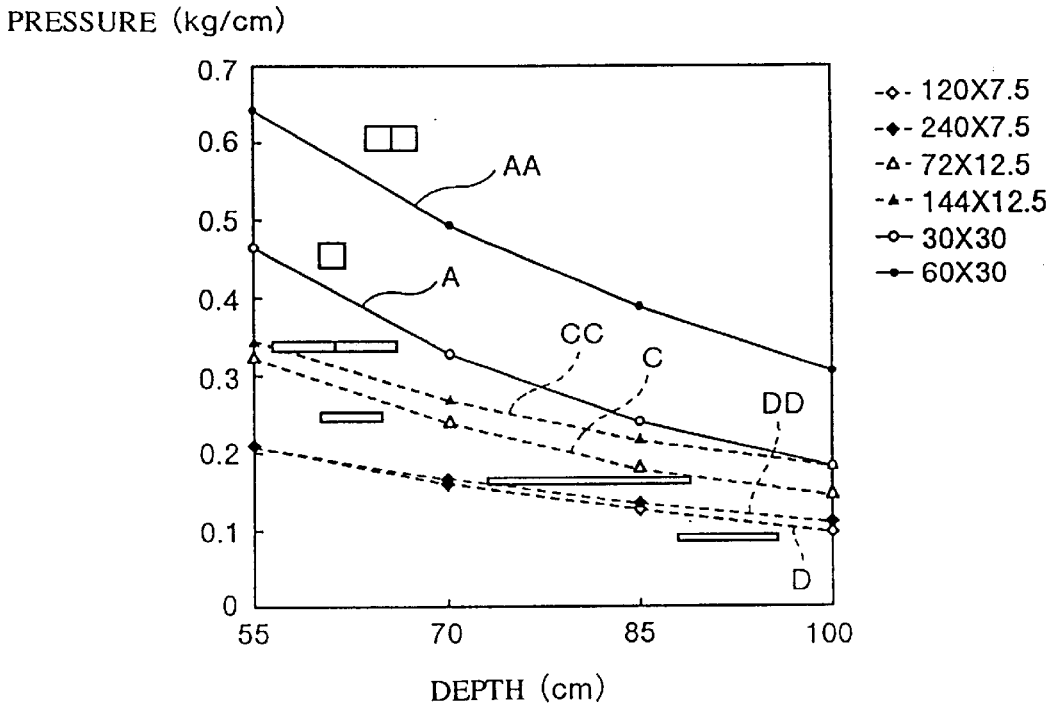
FIG. 15 is a graph of characteristic curves showing stresses applied to the ground by various combination of tracks.

(1-6) The track 35 is wide and can sufficiently compact the deep layer of the ground, which will be explained in detail with reference to FIGS. 14 and 15. These figures show characteristic curves of ground stress which are derived on the basis of test results using Boussinesq logical expressions. The abscissa denotes ground depths while the ordinate denotes compressive stress of the ground. In FIG. 14, a characteristic curve A relates to the wide track 35 (shown by the square); a characteristic curve B relates to a slightly narrow track (shown by the rectangle immediately to the left of curve B); a characteristic curve C relates to an ordinary track (shown by the rectangle immediately to the left of curve C); and a characteristic curve D relates to a roller of a roller type compacting machine (that is in line contact with the ground shown by the rectangle immediately to the left of curve D). In FIG. 15, the characteristics curves A, C and D relate to the wide track, the ordinary track, and the roller, similarly to those in FIG. 14. Further, a characteristic curve AA relates to two wide tracks which are juxtaposed; a characteristic curve CC relates to two ordinary tracks which are juxtaposed; and a characteristic curve DD relates to two rollers in line contact with the ground surface. In both of FIGS. 14 and 15, the tracks and rollers were brought into contact with the ground with the same surface pressure per unit area. Specifically, a load of 4,410 Kg was applied to a ground surface of 900 $cm^2$. Each square denotes an area of 30 cm×30 cm; each short rectangle denotes an area of 45 cm×20 cm; each intermediate rectangle denotes an area of 75 cm×12 cm; and each line-contact area is 150 cm×6 cm. It can be understood that the compressive stress on the ground is increased as the ground contact area of the track or roller approaches a square, as shown by the characteristic curves A, B, C and D in FIG. 14, and the characteristic curves A, C and D in FIG. 15. On the basis of the characteristic curves A and AA, C and CC, and D and DD in FIG. 15, it is understood that with two juxtaposed tracks the compressive stress on the ground from the surface layer to a deep layer is increased remarkably with a square contact area A, as compared to the line contact of curve D. This can also be explained as follows. The load applied to the ground surface functions as a so-called stress root, which is extensively attenuated as it is transmitted deeper and wider in the ground. The more adjacent surface pressures there are, the less extensively they are attenuated, since the stress roots of the adjacent surface areas act on one another. Conversely, the fewer surface pressures there are, the less the stress roots act mutually, and the more extensively they are attenuated. Here, the square of curve A corresponds to a case where there are a number of adjacent surface pressures, while the line contact of curve D corresponds to a case where there are fewer adjacent surface pressures. In other words, the wide track 35 can compact the deep layer of the ground to a satisfactory degree.

The invention will be further described with reference to further embodiments.

Figure 16:
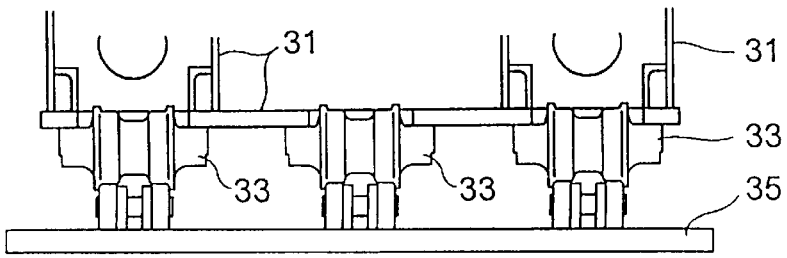
FIG. 16 relates to a second embodiment of the invention, showing the arrangement of three rows of road wheels along the length of the machine to support a track.

In a second embodiment, illustrated in FIG. 16, the road wheels 33 are arranged in three rows on the wide track 35 along the length thereof as compared with the first embodiment where the road wheels 33 are arranged in two rows.

Figure 17:
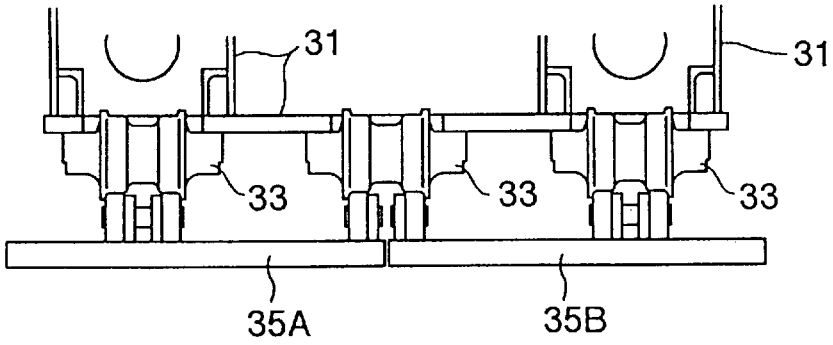
FIG. 17 relates to a third embodiment of the invention, showing the arrangement of three rows of road wheels to support two tracks.

According to a third embodiment, illustrated in FIG. 17, the road wheels 33 are arranged in three rows on two adjacent tracks 35A and 35B in order to support them, as compared with the first embodiment where one wide track 35 is used.

Figure 18:
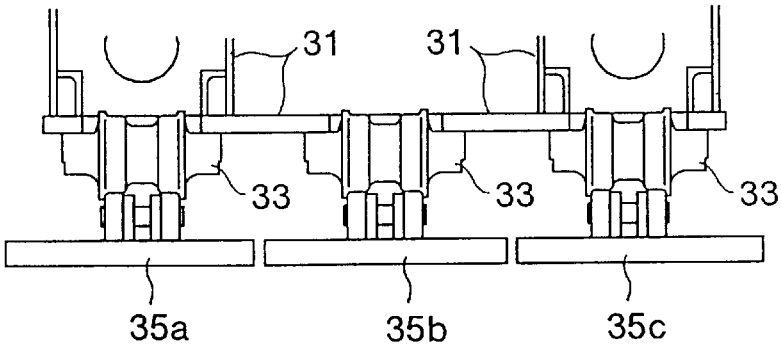
FIG. 18 relates to a fourth embodiment of the invention, showing the arrangement of three rows of road wheels to support three tracks.

With a fourth embodiment, illustrated in FIG. 18, three tracks 35*a*, 35*b* and 35*c* are juxtaposed, as compared with one wide track 35 in the first embodiment, and a plurality of road wheels 33 are arranged in rows with a row on each track along the length thereof. In this case, the track 35*b* can be provided with a driving wheel 32 in place of the drive sprocket 34.

Figure 19:
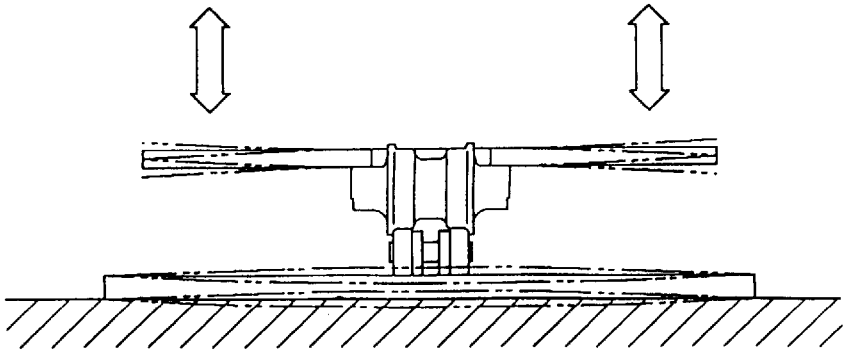
FIG. 19 shows how a track frame and wide track flex between the road wheels which are spaced apart, in the first machine of the first embodiment.

The second to fourth embodiments operate and are advantageous in the following respects. In the first embodiment, the vibrator 40 produces large vibrations. When the two rows of road wheels 33 are arranged along the opposite side edges of the wide track 35, there is a wide free space between the two rows of road wheels 33 on the track frame 31 and the wide track 35. The track frame 31 and the wide track 35 are flexed at the wide free space, as shown in FIG. 19, thereby tending to attenuate vibrations, and reduce the vibrations applied to the ground. In order to overcome this problem, the rigidity of the track frame 31 and the wide track 35 can be increased. This means that these members become expensive and bulky. The larger these members, the smaller the vibrator 40 should be, which means that the vibrator 40 would produce only small vibrations to be transmitted to the ground. In order to overcome this problem, the number of rows of road wheels is increased in the second and third embodiments, thereby reducing the free space between the road wheels 33 on the track frame 31 and the wide track 35. In other words, the smaller the free spaces between the road wheels 33, the more rigid is the track frame 31 and the wide track 35. The vibrations, generated by the vibrator 40 and the weight of the vibrator 40, uniformly and directly press the wide track 35 to the ground surface and are efficiently transmitted into the ground via the road wheels 33. The ground can be effectively compacted. Alternatively, the road wheels can be arranged in three or more rows, or arranged in a staggered manner.

A plurality of tracks are juxtaposed in the third and fourth embodiments, and are as effective as the wide track 35 in the first embodiment. As described with reference to FIG. 15, a plurality of long and narrow tracks that are juxtaposed are also effective in producing large ground compressive stress in the third embodiment, shown in FIG. 17, and the fourth embodiment, shown in FIG. 18. The ground can be effectively compacted. Specifically, the ground can be reliably compacted so long as the following ratios are observed: the length (30 cm) versus the width (30 cm) is in the ratio of 1:1 for the curve A; and the length (45 cm) versus the width (20 cm) is in the ratio of 1:0.44. A plurality of tracks 35 whose length and width are in the ratio of 1:0.4~1:1 can be juxtaposed.

Figure 20A:
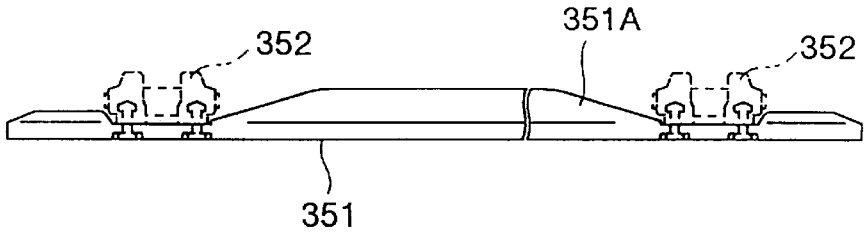
Figure 20B:
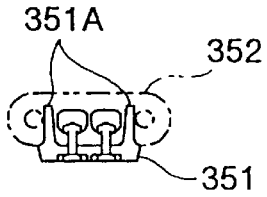

A track usually includes a plurality of track shoes bolted on links. In a fifth embodiment, a track is provided with elongated transverse ribs 351A that are arranged on the inner surface of the track which is not in contact with the ground surface during operation of the track. These ribs 351A are arranged between left and right links 352 on the track shoe 351, constituting the wide track 35 used in the first embodiment, as shown in FIGS. 20A and 20B.

According to the fifth embodiment, the wide track 35 can be made more rigid without being enlarged. Since the wide track 35 does not occupy a large area, the vibrator 40 can be kept large, and apply large vibrations to the ground. The fifth embodiment has been described using the wide track 35 shown in FIGS. 20A and 20B. Any track shoes of crawler type vibratory compacting machines can be used by providing the elongated transverse ribs 351A on the surface of the track shoes that is not brought into contact with the ground during operation of the track. Such track shoes are as effective as those described above.

Figure 21A:
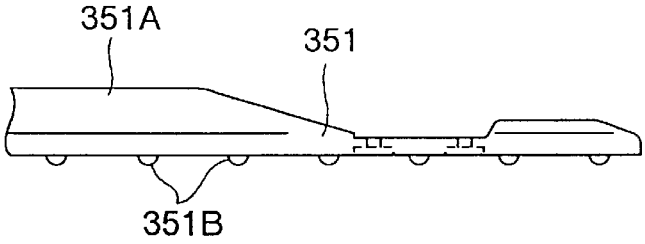
Figure 21B:
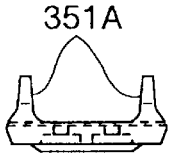
Figure 21C:
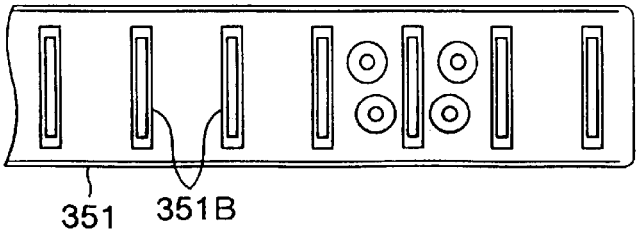

In a sixth embodiment, the track shoe 351 is provided with elongated transverse ribs 351B on the side thereof that is brought into contact with the ground during operations, as shown in FIGS. 21A, 21B and 21C. The ribs 351B are present along the length of the track 35.

The sixth embodiment operates and is effective as follows. A crawler machine includes a plurality of elongated transverse ribs on the outer surface of the track shoe which is in contact with the ground, as with a bulldozer. These ribs are provided in order to increase the tractive force. Since the present invention relates to the crawler vibratory compacting machine, the transmission of vibrations to the ground is preferred to the tractive force. Therefore, the sixth embodiment is designed in order to reliably transmit horizontal vibrations (especially transverse vibrations) to the ground. If the ground surface is concave or convex, the first machine tends to jump up and down and slide to the sides in response to vertical vibrations. The sixth embodiment can suppress such sliding. FIGS. 21A to 21C show that the long transverse ribs are attached to the track shoe of FIGS. 20A and 20B, according to the sixth embodiment. Any type of track shoe of a crawler type vibratory compacting machine can be used by adding elongated transverse ribs 351B along the length of the track shoe. They are as effective as those of the foregoing examples.

A seventh embodiment relates to modifications (first to sixth examples) of the vibrator 40, and will be described with reference to FIGS. 22A to 27A. In the first and third to sixth examples, a vibrating section generates vertical vibrations using one horizontal shaft (either the lateral shaft 42 or the longitudinal shaft 43) having an eccentric weight, as compared with the vibrator 40 in the first embodiment.

Figures 22A, 22B:
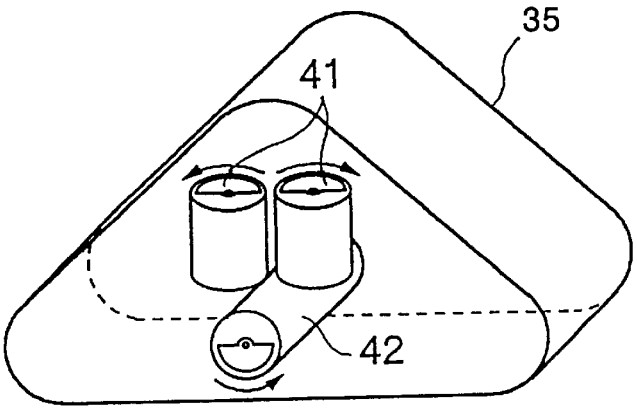

(7-1) In the first example shown in FIG. 22A, the vibrator is constituted by a pair of vertical shafts 41, each having an eccentric weight, and one lateral shaft 42, having an eccentric weight. The first example is effective as follows. When the vertical shafts 41, 41 are rotated, their eccentric weights are simultaneously turned in reverse directions at the same speed. As shown in FIG. 22B, their longitudinal vibrations are cancelled out (as shown by the symbol X) while their transverse vibrations are doubled (as shown by the symbol ⊚). On the other hand, the lateral shaft 42 causes longitudinal and vertical vibrations (as shown by ○).

Figures 23A, 23B:
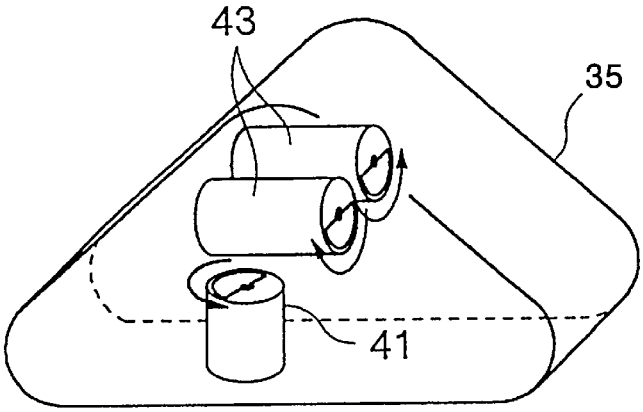
FIG. 23A is a schematic perspective view of the second example.
FIG. 23B shows how vibrations are generated in the second example.
Figures 24A, 24B:
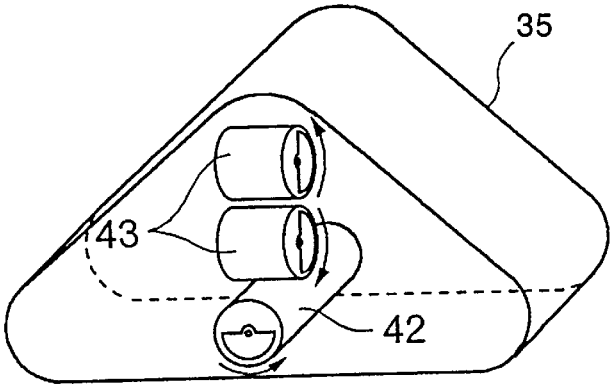
FIG. 24A is a schematic perspective view of the third example.
FIG. 24B shows how vibrations are generated in the third example.

(7-2) According to the second example, the vibrator comprises one vertical shaft 41, having an eccentric weight, and a pair of longitudinal shafts 43, 43, each having an eccentric weight, mounted side by side horizontally as shown in FIG. 23A. The second example is effective in the following respects. The longitudinal shafts 43, 43 are rotated with their eccentric weights simultaneously turned in opposite directions at the same speed, so that their transverse vibrations are cancelled out (as shown by the symbol X in FIG. 23B), while their vertical vibrations are doubled (as shown by the symbol ⊚) On the other hand, the vertical shaft 41 produces longitudinal and transverse vibrations (as shown by ○).

(7-3) In the third example, the vibrator comprises one lateral shaft 42, having an eccentric weight, and a pair of longitudinal shafts 43, 43, each having an eccentric weight mounted side by side vertically. The longitudinal shafts 43, 43 rotate with their eccentric weights simultaneously turning in the opposite directions at the same speed, so that their vertical vibrations are cancelled out (as shown by X in FIG. 24B), while their transverse vibrations are doubled (as shown by ⊚ in FIG. 24B). On the other hand, the lateral shaft 42 generates vertical and longitudinal vibrations (as by shown ○).

Figures 25A, 25B:
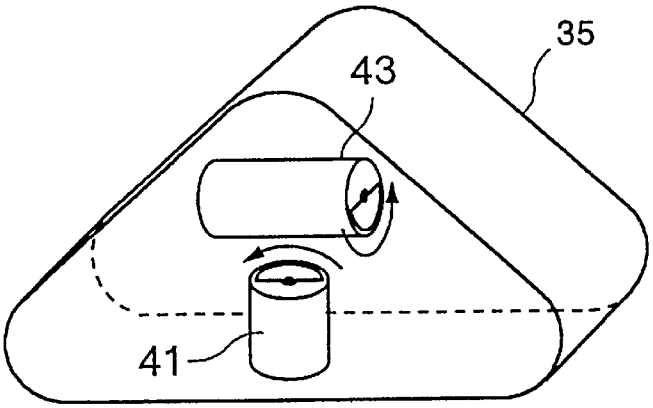
FIG. 25A is a schematic perspective view of the fourth example.
FIG. 25B shows how vibrations are generated in the fourth example.

(7-4) The vibrator in the fourth example comprises one vertical shaft 41 with an eccentric weight and one longitudinal shaft 43 with an eccentric weight, as shown in FIG. 25A. According to this example, the vertical shaft 41 generates longitudinal and transverse vibrations, while the longitudinal shaft 43 generates vertical and transverse vibrations.

Figures 26A, 26B:
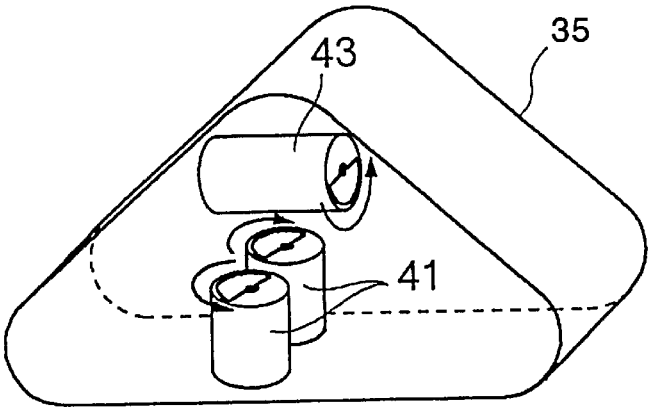
FIG. 26A is a schematic perspective view of the fifth example.
FIG. 26B shows how vibrations are generated in the fifth example.

(7-5) According to the fifth example, the vibrator is constituted by a pair of vertical shafts 41, 41, each having an eccentric weight, and one longitudinal shaft 43, with an eccentric weight (refer to FIG. 26A). When the vertical shafts 41, 41 rotate, their eccentric weights are simultaneously turned in opposite directions at the same speed, so that their transverse vibrations are cancelled out (as shown by speed X in FIG. 26B), while their longitudinal vibrations are doubled (as shown by ⊚). The longitudinal shaft 43 generates transverse and vertical vibrations (as shown in FIG. 26B).

Figures 27A, 27B:
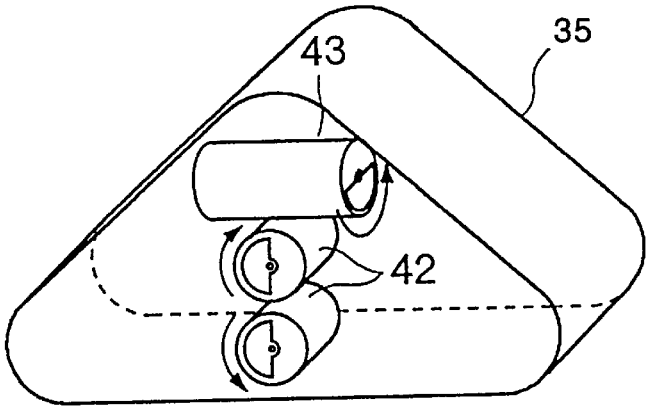

(7-6) Referring to FIG. 27A, the vibrator of the sixth example comprises two transverse shafts 42, 42 and one longitudinal shaft 43. When the transverse shafts 42, 42 rotate, their eccentric weights are simultaneously turned in opposite directions at the same speed, so that their vertical vibrations are cancelled out (as shown by speed X in FIG. 27B) while their longitudinal vibrations are absorbed (as shown by ⊚). On the other hand, the longitudinal shaft 43 causes transverse and vertical vibrations as shown in FIG. 27B.

The vibrator 40 and the vibrators in the first to sixth examples are further advantageous in the following respects. For instance, molding sand is well compacted when it is subjected to vibrations from various directions. This implies that ordinary soil such as a road base can also be well compacted when it is subjected to vibrations and compressed from various directions. In other words, the vibrator 40 and the vibrators in the first to the sixth examples are effective in causing longitudinal, transverse and vertical vibrations which promote compacting of the ground. Referring to FIGS. 22A to 27B, the vibration axes have their vibration centers located substantially in a vertical passing through the center line C1 of the first lateral shaft 23, in the first to sixth examples. The shaft for causing the longitudinal vibrations is usually positioned at the bottom center of the crawler type vibrating section 30 while the remaining shafts are arranged above the foregoing shaft, regardless of whether or not it causes the transverse or the vertical vibrations. Therefore, the vibrator in the seventh embodiment can also suppress the rocking motion which is caused by the vibrator 40 in the first embodiment. This is substantially identical to the advantage referred to in item (1-5) although they are slightly different in details. In the foregoing description, the terms "longitudinal, transverse and vertical vibrations" are used in order to promote clear understanding of the vibrator 40 and the vibrators in the first to sixth examples. Since the vibrations are generated in response to the rotation of the shafts having the eccentric weights, the shafts generate vibrations in the plane that is orthogonal with the axes of the vertical shafts 41, lateral shafts 42, and longitudinal shafts 43.

Figure 28:
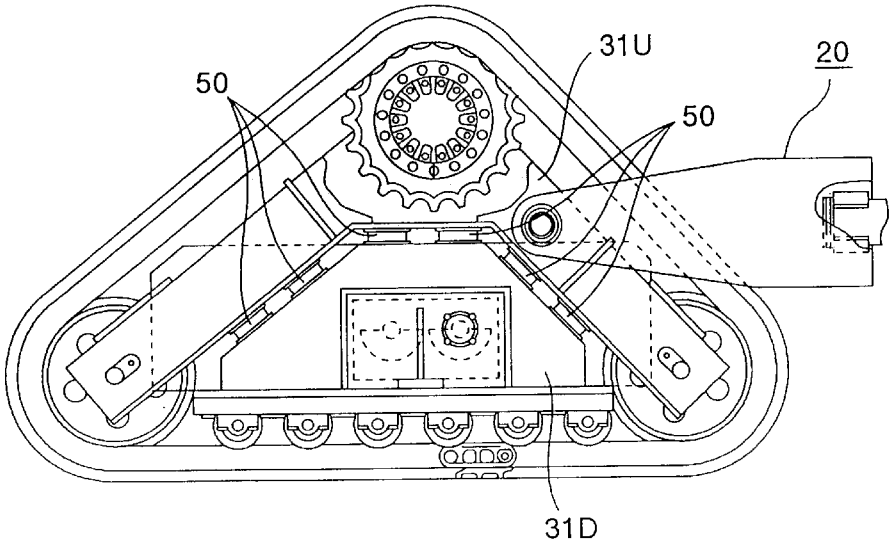
FIG. 28 is a side view of crawler type vibrating section having upper and lower track frames in an eighth embodiment of the invention.

In an eighth embodiment shown in FIG. 28, the track frame 31 in the first embodiment is divided into an upper track frame 31U, having driving wheels 32 and a drive sprocket 34, and a lower track frame 31D, having road wheels 33 and a vibrator 40. The upper and lower track frames 31U and 31D are coupled via second elastic members 50.

The eighth embodiment operates and is advantageous as follows. In the first embodiment, the large vibrator 40 is housed in the track frame 31, and large vibrations are directly transmitted to the driving wheels 32 and the drive sprocket 34. Therefore, there is a possibility that these wheels may be damaged. However, in the eighth embodiment, the upper and track frames 31U and 31D are coupled via the second elastic members 50, which absorb large vibrations. As a result, they are substantially prevented from being transmitted to the upper track frame 31U (i.e. to the driving wheels 32 and the drive sprocket 34), which is protected against damage. Further, transmission of vibrations to the vehicle body 10 can be suppressed since the yoke-shaped member 20 is coupled to the upper track frame 31U that is coupled to the vibrator 40 via the second elastic members 50. Therefore, the first elastic members 36 may be dispensable in this arrangement. On the other hand, it is preferable to use the first elastic members 36 when the yoke-shaped member 20 is coupled to the lower track frame 31D, thereby suppressing transmission of vibrations to the vehicle body 10.

Figure 29:
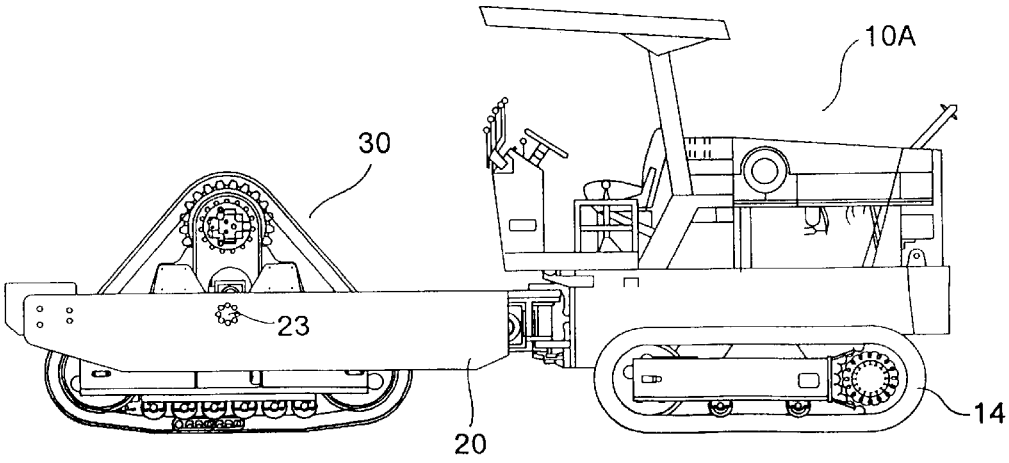
FIG. 29 is a side view of a second machine in accordance with a ninth embodiment of the invention.
Figure 30:
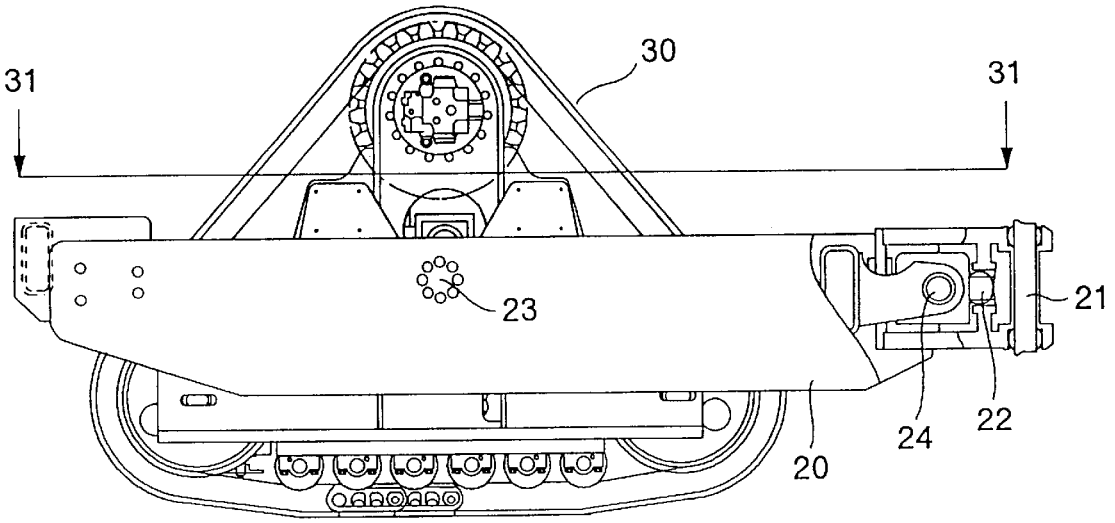
FIG. 30 is an enlarged view of a yoke-shaped member and a crawler type vibrating section of the second machine shown in FIG. 29.
Figure 31:
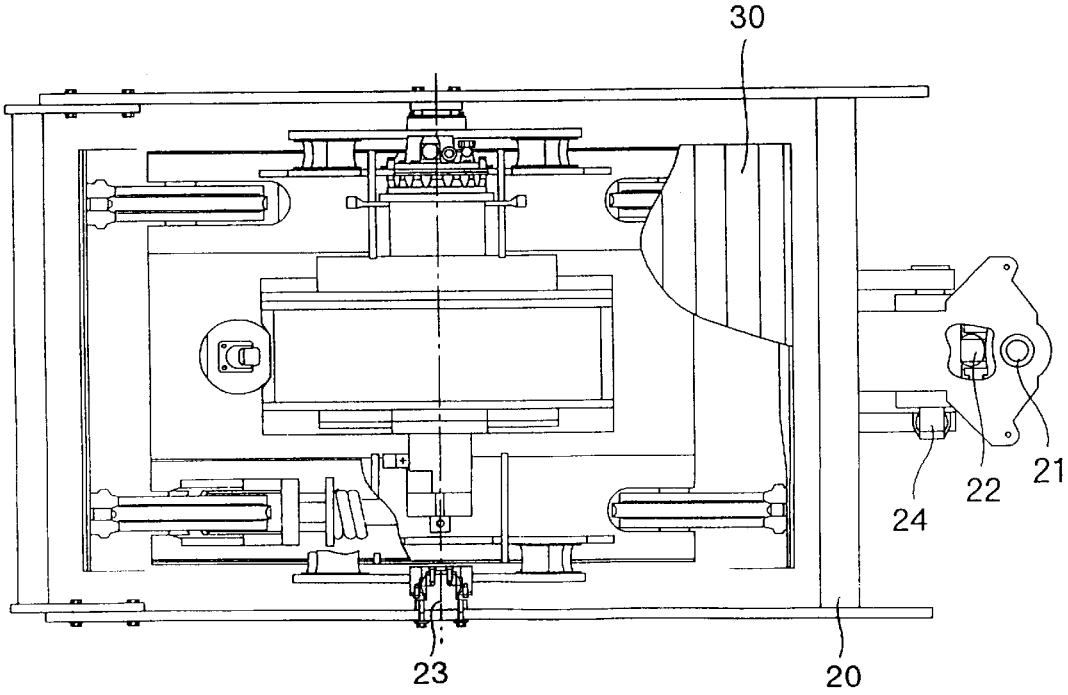
FIG. 31 is a sectional view, taken along line 31—31 in FIG. 30.

In a ninth embodiment of the invention, a crawler type vibratory compacting machine (called the "second machine") comprises a pair of tracks 14, a vehicle body 10A, a yoke-shaped member 20, and a crawler vibrating section 30, as shown in FIGS. 29 to 31. The vehicle body 10A is of a crawler type that is different from the wheel type vehicle body 10 in the first embodiment. The vehicle body 10A and the yoke-shaped member 20 are coupled together using pivot pins. Specifically, the yoke-shaped member 20 has its rear center coupled to the front center of the vehicle body 10A via a vertical shaft 21, a longitudinal shaft 22, and a horizontal shaft 24 (called the "second lateral shaft 24"). The second machine is provided with a first lateral shaft 23 between the crawler type vibrating section 30 and the yoke-shaped member 20, similarly to the first machine, as shown in FIG. 31.

The second machine of the ninth embodiment is improved in the following respects, as compared with the first machine example. Specifically, the first horizontal shaft 23 allows the crawler type vibrating section 30 to pitch freely with respect to the yoke-shaped member 20. However, when large vibrations are required to compact a thick layer of the ground, the first elastic members 36 of the first machine cannot attenuate the vibrations sufficiently, which means that the trawler type vibratory compacting machine cannot operate in an optimum state. On the other hand, in the second machine, the second lateral shaft 24 turns when the vibrating section 30 generates large vibrations. In other words, vertical vibrations, generated by the vibrating section 30, are absorbed by the second lateral shaft 24, thereby enabling the crawler type vibratory compacting machine to operate in an optimum state. Further, if the vibrating section 30 suffers from pitching on an uneven road surface, the second lateral shaft 24 absorbs such pitching, and assures reliable operation of the crawler type vibratory compacting machine.

In the first to ninth embodiments, the crawler type vibratory compacting machines include the crawler type vibrating sections 30 that have the vibrators 40 housed in the triangular track units. A crawler type vibratory compacting machine of a tenth embodiment can comprise an existing track frame, and a track unit provided with a vibrating section. Such track frame usually includes a driving wheel at its front part, a drive sprocket at its rear part, and a plurality of road wheels sandwiched between the driving wheel and the drive sprocket, and a track wound around the wheels.

INDUSTRIAL APPLICABILITY

The crawler type vibratory compacting machine of the present invention is useful for efficiently compacting soft ground, as well as ordinary ground, from a surface layer to a deep layer, without problems caused by vibrations.

What is claimed is:

1. A crawler vibratory compacting machine comprising:

a vehicle body;

a triangular crawler unit; and a member for supporting said triangular crawler unit, said member pivotably coupled to said vehicle body, wherein said triangular crawler unit includes:

a track frame;

a plurality of wheels arranged along a length of said track frame;

a plurality of sprockets arranged above said track frame;

at least one track wound around said plurality of wheels and said plurality of sprockets; and a vibrator, which is housed within said triangular crawler unit.

2. A crawler vibratory compacting machine in accordance with claim 1, wherein said member for supporting said triangular crawler unit comprises a yoke-shaped member having two spaced apart arms; and a first horizontal lateral shaft located in a central portion of said triangular crawler unit, with opposite ends of said first horizontal lateral shaft being coupled to respective ones of said spaced apart arms.

3. A crawler vibratory compacting machine in accordance with claim 2, wherein said vehicle body includes an operator's seat.

4. A crawler vibratory compacting machine in accordance with claim 2, wherein said vibrator includes at least a vertical vibrating unit for generating vertical vibrations, and wherein said vertical vibrating unit has a vibration center that is substantially located in a vertical line passing through a centerline of said first horizontal lateral shaft.

5. A crawler vibratory compacting machine in accordance with claim 2, further comprising attenuating means provided between said triangular crawler unit and said yoke-shaped member to attenuate forces generated by a relative rotation of said triangular crawler unit and said yoke-shaped member around said first horizontal lateral shaft.

6. A crawler vibratory compacting machine in accordance with claim 2, further comprising:

a plurality of road wheels which are arranged on an underside of said track frame along the length of said track frame, wherein mounting positions of said plurality of road wheels include:

a center mounting position at a center of said track frame, at least one front mounting position located between said center mounting position and a front of said triangular crawler unit, and at least one rear mounting position located between said center mounting position and a rear of said triangular crawler unit, with each of said at least one front mounting position having a higher position than said center mounting position and any other front mounting position between the respective front mounting position and said center mounting position, and with each of said at least one rear mounting position having a higher position than said center mounting position and any other rear mounting position between the respective rear mounting position and said center mounting position.

7. A crawler vibratory compacting machine in accordance with claim 1, further comprising:

a plurality of road wheels which are arranged on an underside of said track frame along the length of said track frame, wherein mounting positions of said plurality of road wheels include:

a center mounting position at a center of said track frame, at least one front mounting position located between said center mounting position and a front of said triangular crawler unit, and at least one rear mounting position located between said center mounting position and a rear of said triangular crawler unit, with each of said at least one front mounting position having a higher position than said center mounting position and any other front mounting position between the respective front mounting position and said center mounting position, and with each of said at least one rear mounting position having a higher position than said center mounting position and any other rear mounting position between the respective rear mounting position and said center mounting position.

8. A crawler vibratory compacting machine in accordance with claim 1, wherein said vibrator comprises:

a horizontal vibrating unit, for generating horizontal vibrations; and a vertical vibrating unit, for generating vertical vibrations.

9. A crawler vibratory compacting machine in accordance with claim 8, wherein said horizontal vibrating unit is positioned at a bottom center portion of said triangular crawler unit, and wherein said vertical vibrating unit is positioned above said horizontal vibrating unit.

10. A crawler vibratory compacting machine in accordance with claim 1, wherein said vibrator comprises:

a pair of vertical shafts, each having an eccentric weight; and a horizontal shaft, having an eccentric weight;

wherein when said vertical shafts are rotated in opposite directions at a common speed, they cancel out their longitudinal vibrations and double their transverse vibrations.

11. A crawler vibratory compacting machine in accordance with claim 1, wherein said vibrator comprises:

a pair of horizontal shafts, each having an eccentric weight, mounted side by side horizontally; and a vertical shaft, having an eccentric weight;

wherein when said horizontal shafts are rotated in opposite directions at a common speed, they cancel out their transverse vibrations and double their vertical vibrations.

12. A crawler vibratory compacting machine in accordance with claim 1, wherein said vibrator comprises:

a pair of longitudinally horizontal shafts, each having an eccentric weight, mounted side by side vertically; and a laterally horizontal shaft, having an eccentric weight;

wherein when said longitudinally horizontal shafts are rotated in opposite directions at a common speed, they cancel out their vertical vibrations and double their transverse vibrations.

13. A crawler vibratory compacting machine in accordance with claim 1, wherein said vibrator comprises:

a longitudinally horizontal shaft, having an eccentric weight; and a vertical shaft, having an eccentric weight.

14. A crawler vibratory compacting machine in accordance with claim 1, wherein said vibrator comprises:

a pair of vertical shafts, each having an eccentric weight, mounted side by side; and a longitudinally horizontal shaft, having an eccentric weight;

wherein when said vertical shafts are rotated in opposite directions at a common speed, they cancel out their transverse vibrations and double their longitudinal vibrations.

15. A crawler vibratory compacting machine in accordance with claim 1, wherein said vibrator comprises:

a pair of laterally horizontal shafts, each having an eccentric weight, mounted side by side vertically; and a longitudinally horizontal shaft, having an eccentric weight;

wherein when said laterally horizontal shafts are rotated in opposite directions at a common speed, they cancel out their vertical vibrations and double their longitudinal vibrations.

16. A crawler vibratory compacting machine in accordance with claim 1, further comprising:

a first laterally horizontal shaft located in a central portion of said triangular crawler unit, with opposite ends of said first laterally horizontal shaft being coupled to respective ones of said spaced apart arms; and a second laterally horizontal shaft, wherein said yoke-shaped member is pivotably coupled to said vehicle body via said second laterally horizontal shaft, wherein said member for supporting said triangular crawler unit comprises a yoke-shaped member having two spaced apart arms.

17. A crawler vibratory compacting machine in accordance with claim 16, wherein said vehicle body includes an operator's seat.

18. A crawler vibratory compacting machine in accordance with claim 1, wherein said track frame comprises:

an upper track frame, for housing said plurality of wheels and said plurality of sprockets; and a lower track frame, for housing said vibrator;

wherein said upper and lower track frames are coupled to each other via elastic members.

19. A crawler vibratory compacting machine in accordance with claim 1, where in a ground contact area of said at least one track wound around said plurality of wheels and said plurality of sprockets is a substantially square area.

20. A crawler vibratory compacting machine in accordance with claim 19, further comprising a plurality of road wheels disposed on an underside of said track frame, wherein said plurality of road wheels are arranged in a plurality of rows on said at least one track.

21. A crawler vibratory compacting machine in accordance with claim 1, wherein said at least one track wound around said plurality of wheels and said plurality of sprockets comprises a plurality of juxtaposed tracks which are wound around said plurality of wheels and said plurality of sprockets.

22. A crawler vibratory compacting machine in accordance with claim 21, further comprising a plurality of road wheels disposed on an underside of said track frame, wherein said plurality of road wheels are arranged in a plurality of rows on said plurality of juxtaposed tracks.

23. A crawler vibratory compacting machine in accordance with claim 1, wherein each said at least one track comprises a plurality of track shoes, wherein each of said plurality of track shoes has a non-contact surface which is not brought into contact with a ground surface during operation of said crawler vibratory compacting machine, and wherein said each of said plurality of track shoes includes elongated transverse ribs arranged across said non-contact surface.

24. A crawler vibratory compacting machine in accordance with claim 23, wherein said each of said plurality of track shoes has a contact surface which is brought into contact with a ground surface during operation of said crawler vibratory compacting machine, and wherein said each of said plurality of track shoes includes elongated ribs arranged across said contact surface.

25. A crawler vibratory compacting machine in accordance with claim 1, wherein each said at least one track comprises a plurality of track shoes, wherein each of said plurality of track shoes has a contact surface which is brought into contact with a ground surface during operation of said crawler vibratory compacting machine, and wherein said each of said plurality of track shoes includes elongated transverse ribs arranged across said contact surface.

26. A crawler vibratory compacting machine comprising:

a vehicle body;

a crawler unit; and a member for supporting said crawler unit, said member pivotably coupled to said vehicle body, wherein said crawler unit includes:

a track frame;

at least one track wound around said track frame; and a vibrator, which is housed within said crawler unit, wherein each said at least one track comprises a plurality of track shoes, wherein each of said plurality of track shoes has a non-contact surface which is not brought into contact with a ground surface during operation of said crawler vibratory compacting machine, and wherein said each of said plurality of track shoes includes elongated ribs arranged across said non-contact surface.

27. A crawler vibratory compacting machine in accordance with claim 26, wherein said each of said plurality of track shoes has a contact surface that is brought into contact with a ground surface during operation of said crawler vibratory compacting machine, and wherein said each of said plurality of track shoes includes elongated ribs arranged across said contact surface.

28. A crawler vibratory compacting machine comprising:

a vehicle body;

a crawler unit; and a member for supporting said crawler unit, said member pivotably coupled to said vehicle body, wherein said crawler unit includes:

a track frame;

at least one track wound around said track frame; and a vibrator, which is housed within said crawler unit;

wherein each said at least one track comprises a plurality of track shoes, wherein each of said plurality of track shoes has a contact surface which is brought into contact with a ground surface during operation of said crawler vibratory compacting machine, and wherein said each of said plurality of track shoes includes elongated ribs arranged across said contact surface.

* * * * *